US009065196B2

(12) United States Patent
Ohnuma et al.

(10) Patent No.: US 9,065,196 B2
(45) Date of Patent: Jun. 23, 2015

(54) COMPRESSION METHOD FOR ELECTRIC WIRE AND ELECTRIC WIRE WITH TERMINAL OBTAINED THEREBY

(71) Applicant: Yazaki Corporation, Tokyo (JP)

(72) Inventors: Kentaro Ohnuma, Makinohara (JP); Tadahisa Sakaguchi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 8 days.

(21) Appl. No.: 14/174,278

(22) Filed: Feb. 6, 2014

(65) Prior Publication Data

US 2014/0154915 A1 Jun. 5, 2014

Related U.S. Application Data

(63) Continuation of application No. PCT/JP2012/070717, filed on Aug. 8, 2012.

(30) Foreign Application Priority Data

Aug. 8, 2011 (JP) ..... 2011-173340

(51) Int. Cl.

| | |
|---|---|
| ***H01R 4/20*** | (2006.01) |
| ***H01R 13/52*** | (2006.01) |
| ***H01R 4/18*** | (2006.01) |
| ***H01R 4/62*** | (2006.01) |

(52) U.S. Cl.

CPC ..... *H01R 13/52* (2013.01); *H01R 4/184* (2013.01); *H01R 4/20* (2013.01); *H01R 4/62* (2013.01)

(58) Field of Classification Search

CPC ..... H01R 4/20; H01R 4/188; H01R 4/183; H01R 4/185

See application file for complete search history.

(56) References Cited

U.S. PATENT DOCUMENTS

| | | | | |
|---|---|---|---|---|
| 4,813,893 | A * | 3/1989 | Sindlinger | 439/730 |
| 5,749,756 | A * | 5/1998 | Vockroth et al. | 439/879 |
| 6,334,798 | B1 * | 1/2002 | Ushijima et al. | 439/879 |
| 6,951,491 | B2 * | 10/2005 | Sakaguchi et al. | 439/879 |
| 7,422,480 | B1 * | 9/2008 | Musick et al. | 439/585 |
| 7,494,388 | B2 * | 2/2009 | Kakuta | 439/879 |
| 2001/0005647 | A1 | 6/2001 | Endo et al. | |

(Continued)

FOREIGN PATENT DOCUMENTS

| | | |
|---|---|---|
| DE | 1097504 B | 1/1961 |
| GB | 691157 A | 5/1953 |

(Continued)

OTHER PUBLICATIONS

International Search Report (ISA/PCT/210) dated Nov. 7, 2012 from the International Searching Authority in International Application No. PCT/JP2012/070717.

Written Opinion (ISA/PCT/237) dated Nov. 7, 2012 from the International Searching Authority in International Application No. PCT/JP2012/070717.

*Primary Examiner* — Gary Paumen

(74) *Attorney, Agent, or Firm* — Sughrue Mion, PLLC

(57) ABSTRACT

An electric wire with terminal is provided to include: an inner terminal including a crimp part that is crimped to compress a conductor part of a covered electric wire; an outer terminal that is compressed to the inner terminal by a front part thereof and is compressed to the covered electric wire by a rear part thereof; and a waterproof seal sleeve that is attached to a tip of the conductor part of the covered electric wire, wherein the seal sleeve is crimped by the crimp part of the inner terminal.

3 Claims, 7 Drawing Sheets

(56) References Cited

U.S. PATENT DOCUMENTS

| | | | |
|---|---|---|---|
| 2002/0058447 | A1 | 5/2002 | Endo et al. |
| 2005/0227549 | A1 | 10/2005 | Takayama |

FOREIGN PATENT DOCUMENTS

| | | | |
|---|---|---|---|
| JP | 2000251961 | A | 9/2000 |
| JP | 2004207172 | A | 7/2004 |

* cited by examiner

COMPRESSION METHOD FOR ELECTRIC WIRE AND ELECTRIC WIRE WITH TERMINAL OBTAINED THEREBY

CROSS REFERENCE TO RELATED APPLICATIONS

This application is a continuation of PCT application No. PCT/JP2012/070717, which was filed on Aug. 8, 2012 based on Japanese Patent Application (No. 2011-173340) filed on Aug. 8, 2011, the contents of which are incorporated herein by reference.

BACKGROUND OF THE INVENTION

1. Field of the Invention

The present invention relates to an electric wire compression method compressing a conductor part of an electric wire to a compression terminal, and an electric wire with a terminal obtained by the method.

2. Description of the Related Art

In the related art, as an example of the electric wire compression method of compressing a conductor part of the electric wire to the compression terminal, a method of placing a conductive member has been known (for example, see JP-A-2000-251961).

The compression terminal disclosed in JP-A-2000-251961 is constituted by an electrical contact section and a wire compression section, and the wire compression section is formed with a conductor compression section for compression the conductor part of the electric wire, and a cover compression section for compression a covering section of the electric wire. The conductor compression section is provided with a stripe-like conductive member. The conductive member contributes to embedding a gap between the conductor compression section and the conductor part generated during compression in a gas-tight state.

SUMMARY OF THE INVENTION

According to the art described in JP-A-2000-251961, a method of manufacturing the compression terminal with high compression reliability and easy process management is obtained. Since an aluminum electric wire is normally used as the electric wire and a copper terminal is used as the terminal, when water enters the compression section, it has been found that galvanic corrosion due to an electric potential difference between different metals is generated, and there is a concern that the electric resistance of the compression section may rise and mechanical fixing force may fall.

For this reason, there is a need for an electric wire with a terminal including a corrosion prevention technique.

In order to prevent the corrosion, (a) a technique of inserting a rubber cap into the electric wire or (b) a technique of applying resin to an end section of an electric wire is considered. However, since a rubber cap insertion tool is required for the insertion of the rubber cap and a resin application tool is required for the resin application, flexible production has been difficult.

The present invention has been made under the circumstances mentioned above, and an object thereof is to provide an electric wire compression method and an electric wire with a terminal in which galvanic corrosion due to the electric potential difference between the different metals is not generated even in an electric wire with the terminal using an aluminum electric wire and a copper terminal, and thus there is no concern that the electric resistance of the compression section may rise and the mechanical fixing force may fall.

In order to achieve the object, the present invention may provide any one of the following configurations 1 to 6.

1) A compression method for an electric wire for compressing a terminal to a conductor part exposed by removing a covering section of a covered electric wire to form an electrically connected electric wire with the terminal, the compression method including:

(1) a process of removing the covering section of the covered electric wire;

(2) a process of setting a tip of the conductor part, from which the covering section is removed in the process (1), in a crimp part of an inner terminal that includes an electric connection section that is connected to a mating terminal and the crimp part that is crimped to compress the conductor part, thereby compressing and connecting the inner terminal; and (3) a process of setting the inner terminal compressed and connected in the process (2) in a front part of an outer terminal, setting the covering section of the covered electric wire in a rear part of the outer terminal, and compressing and connecting the front part and the rear part of the outer terminal, the outer terminal having the front part and the rear part in a longitudinal direction, wherein the compression method further includes:

(a) a process of attaching a waterproof seal sleeve to the tip of the conductor part, from which the covering section is removed in the process (1), between the processes (1) and (2), and (b) simultaneously setting the waterproof seal sleeve when setting the tip of the conductor part, and compressing and connecting the inner terminal, whereby the waterproofing is performed between the covered electric wire and the outer terminal in the rear part of the outer terminal, and also the waterproofing is performed between the inner terminal and the outer terminal in the front part of the outer terminal.

2) The compression method according to the configuration 1), wherein the waterproof seal sleeve includes a seal sleeve having a cap shape formed of metal or resin.

3) The compression method according to the configuration 1), wherein the crimp part of the inner terminal is provided with a serration formed of a plurality of concavities and convexities.

4) An electric wire with terminal, including:

an inner terminal including a crimp part that is crimped to compress a conductor part of a covered electric wire;

an outer terminal that is compressed to the inner terminal by a front part thereof and is compressed to the covered electric wire by a rear part thereof; and a waterproof seal sleeve that is attached to a tip of the conductor part of the covered electric wire, wherein the seal sleeve is crimped by the crimp part of the inner terminal.

5) The electric wire with terminal according to the configuration 4), wherein the waterproof seal sleeve includes a seal sleeve having a cap shape formed of metal or resin.

6) The electric wire with terminal according to the configuration 4), wherein the crimp part of the inner terminal is provided with a serration formed of a plurality of concavities and convexities.

According to the compression method of 1) mentioned above, since a waterproof seal sleeve is attached to a tip of a conductor part with a covering section removed therefrom, and the seal sleeve is compressed and connected by an inner terminal, a gap allowing water to enter is not formed between the conductor part tip and the inner terminal. Thus, since water does not enter, even in the electric wire with the terminal using the aluminum electric wire and the copper terminal, galvanic corrosion due to the electric potential difference between the different metals is not generated. Accordingly, there is no concern that the electric resistance of the compression section may rise and the mechanical fixing strength may fall.

According to the compression method of 2) mentioned above, since the cap-like seal sleeve formed of metal or resin is used as the waterproof seal sleeve, the waterproof can be simple, and thus productivity is improved.

According to the electric wire compression method of 3) mentioned above, a serration formed of a plurality of concavities and convexities is provided in a crimp part of the inner terminal, and the serration is strongly compressed to the conductor part of the tip of the covered electric wire.

Thus, even when the conductive member as in JP-A-2000-251961 is not used, the relative movement cannot be performed.

According to the electric wire with terminal of 4) mentioned above, the seal sleeve made of metal or resin is attached to the tip of the conductor part, and the seal sleeve is crimped by the inner terminal. Thus, a gap allowing water to enter is not formed between the conductor part tip and the inner terminal. Accordingly since water does not enter, even in the aluminum electric wire and the electric wire with the terminal using the cooper terminal, galvanic corrosion due to the electric potential difference between the different metals is not generated. Thus, there is no concern that the electrical resistance of the compression section may rise and the mechanical fixing force may fall.

According to the electric wire with terminal of 5) mentioned above, since the cap-like seal sleeve formed of metal or resin is used as the waterproof seal sleeve, the waterproof can be simple, and thus productivity is improved.

According to the electric wire with terminal of 6) mentioned above, a serration formed of a plurality of concavities and convexities is provided in a crimp part of the inner terminal, and the serration is strongly compressed to the conductor part of the tip of the covered electric wire. Thus, even when the conductive member as in JP-A-2000-251961 is not used, the relative movement cannot be performed.

DETAILED DESCRIPTION OF THE EXEMPLARY EMBODIMENTS

An embodiment of the present invention, in which galvanic corrosion due to the electric potential difference between the different metals is not generated even in an aluminum electric wire and an electric wire with a terminal using a copper terminal, will be described below in detail based on the drawings.

Figure 1A:
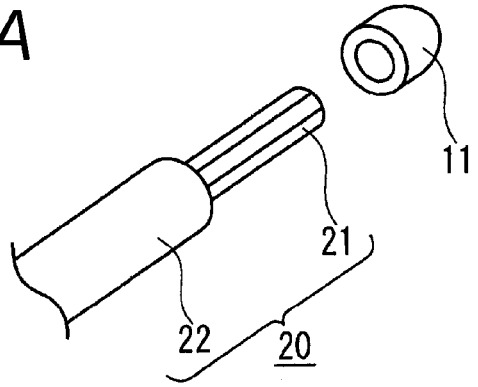
FIG. 1A is a perspective view before an assembly of a covered electric wire and a seal sleeve used in an electric wire compression method according to an embodiment of the present invention.
Figure 1B:
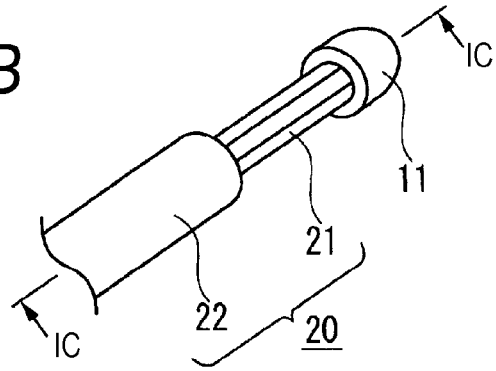
FIG. 1B is a perspective view after the assembly of the covered electric wire and the seal sleeve.
Figure 1C:
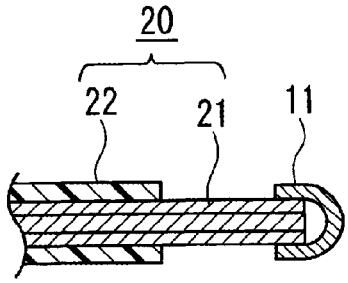
FIG. 1C is a cross-sectional view taken along a line IC-IC in FIG. 1B.

FIG. 1A is a perspective view before an assembly of a covered electric wire and a seal sleeve used in an electric wire compression method according to the embodiment of the present invention. FIG. 1B is a perspective view after the assembly of the covered electric wire and the seal sleeve. FIG. 1C is a cross-sectional view taken along a line IC-IC in FIG. 1B. In FIG. 1A, there are shown a seal sleeve 11, a covered electric wire 20, a conductor part 21, and a covering section 22.

<Seal Sleeve 11>

The seal sleeve 11 has a cap shape made of metal or resin. The inner diameter of the seal sleeve 11 is preferably slightly greater than the diameter of the conductor part (a core wire) 21 of the covered electric wire 20 and is equal to or smaller than an outer diameter of the covering section 22. The depth (a height) of an internal space of the seal sleeve 11 is longer than the length from a tip of the conductor part 21 to an end of a crimp part 31 of an inner terminal 30 (see FIG. 2A(2)) in a state where the tip of the conductor part 21 of the covered electric wire 20 is crimped to the crimp part 31 (see FIG. 2B).

<Covered Electric Wire 20>

The covered electric wire 20 is configured so that the conductor part 21 is received in the covering section 22 and, for example, a multi-core aluminum wire is selected as the conductor part 21.

<Assembling of Seal Sleeve 11 in Embodiment>

In FIG. 1A, the covering section 22 of the covered electric wire 20 is removed as much as the tip portion of the conductor part 21 so that the conductor part 21 is exposed. When covering and assembling the tip of the conductor part 21 with the seal sleeve 11, a state shown in FIG. 1B is obtained.

FIG. 1C is a cross-sectional view taken along the line IC-IC in FIG. 1B. As understood from FIG. 1C, the tip of the conductor part 21 is assembled in a state of coming into contact with the inside of the seal sleeve 11.

<Electric Wire with Inner Terminal>

Figure 2A:
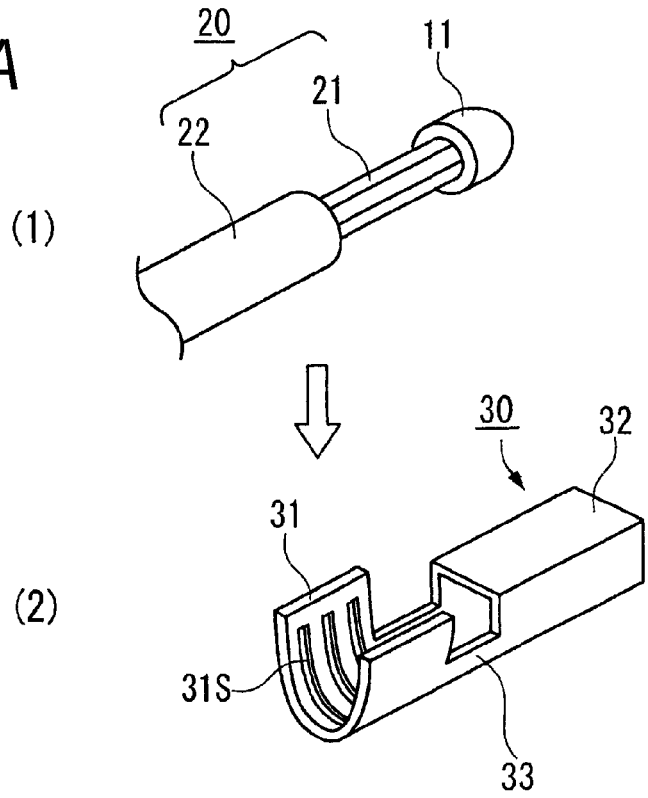
FIG. 2A is a perspective view before compression a covered electric wire assembled with the seal sleeve to an inner terminal, in which: (1) is a perspective view of the covered electric wire assembled with the seal sleeve; and (2) is a perspective view of the inner terminal.
Figure 2B:
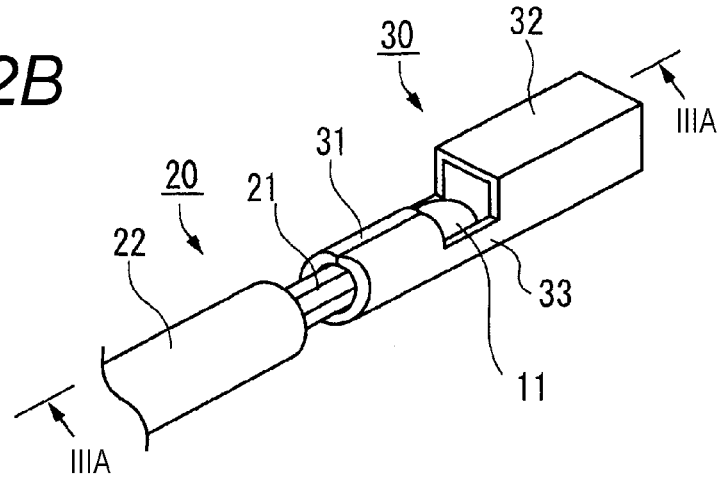
FIG. 2B is a perspective view after compression the covered electric wire assembled with the seal sleeve to the inner terminal.

When the covered electric wire 20, in which the seal sleeve 11 is assembled to the tip of the conductor part 21 as shown in FIG. 2A(1), is compressed to the inner terminal 30 shown in FIG. 2A(2), an electric wire with an inner terminal as shown in FIG. 2B is obtained.

In FIG. 2A(2), the inner terminal 30 is configured so that a rear end thereof is formed with a crimp part 31 for crimping the conductor part 21 of the covered electric wire 20 by bending a conductive metal, a tip thereof is formed with an electric connections section 32 connected to an mating terminal, and the crimp part 3 and the electric connection section 32 are connected by an interconnecting section 33 having a short length and a U-shaped cross-section.

<Crimp Part 31>

The crimp part 31 is formed in a U shape when viewed in a longitudinal cross-section, and a serration 31S constituted by concavities and convexities is formed inside the crimp part 31. The serration 31S in FIG. 2A is realized by a plurality of concave and convex grooves which are extended in a direction of vertically crossing an axis and are parallel to each other. That is, by forming the concave grooves with respect to the surface of the crimp part 31 so as to be parallel to each other, the surface of the crimp part 31 between two concave grooves adjacent to each other becomes a convex section, and a plurality of concave and convex grooves parallel to each other is realized. By forming such a serration 31S, the conductor part 21 and the crimp part 31 cannot be moved relative to each other.

Furthermore, conversely, by forming the convex section with respect to the surface of the crimp part 31 so as to be parallel to each other, the surface of the crimp part 32 between the two convex sections adjacent to each other becomes the concave surface, and it is also possible to realize a plurality of concave and convex grooves parallel to each other.

In addition, although the serration 31S is realized by a plurality of linear concavities and convexities herein, as will be described in FIGS. 7A to 7C, it is also possible to realize the serration by rectangular concavities and convexities, diamond-shaped concavities and convexities, or circular concavities and convexities.

<Electric Connection Section 32>

The electric connection section 32 is formed in a male type or a female type, and is electrically connected to a mating terminal of the female type or the male type. In FIG. 2A, the electrical connection section 32 is a hollow and elongated square pole and is the female type, and the corresponding male terminal is inserted to the internal cavity.

<Interconnecting Section 33>

The interconnecting section 33 is a part that connects between the crimp part 31 forming a U-shaped cross-section and the electric connection section 32 having a square-shaped cross-section, and forms a U shape shorter than the U shape of the crimp part 31. The tip section of the seal sleeve 11 adopted in the embodiment is received in the interconnecting section 33. In addition, the rear end section of the seal sleeve 11 is received in the front end of the crimp part 31 and is crimped by the crimp part 31.

As described above, when accommodating and compression the covered electric wire 20 (FIG. 2A(1)) assembled with the seal sleeve 11 to the inner terminal 30 shown in FIG. 2A(2) so that the tip of the seal sleeve 11 is caught in the U-shaped groove of the interconnecting section 33 of the inner terminal 30 and the rear end of the seal sleeve 11 is caught in an edge section of the crimp part 31 of the inner terminal 30, an electric wire with the inner terminal as shown in FIG. 2B is obtained. As understood from the cross-sectional view of FIG. 3A, since the rear end of the seal sleeve 11 is compressed by the edge section of the crimp part 31 of the inner terminal 30, water does not enter the electric wire with the inner terminal from the tip of the conductor part 21 of the covered electric wire 20.

Figure 3A:
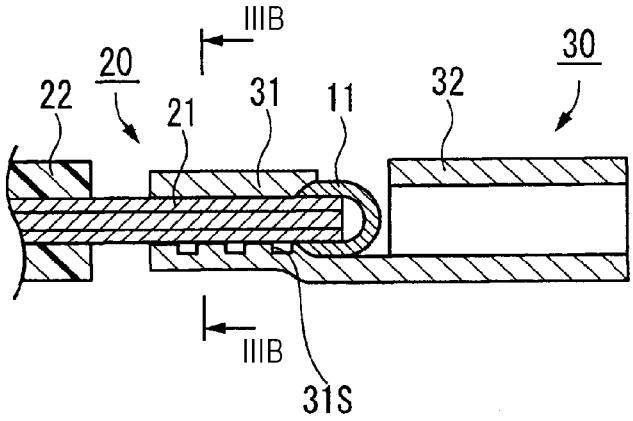
FIG. 3A is a cross-sectional view taken along a line IIIA-IIIA in FIG. 2B.
Figure 3B:
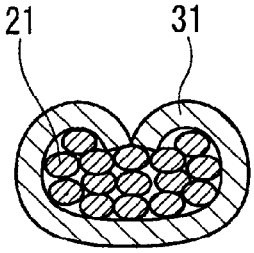
FIG. 3B is a cross-sectional view taken along a line IIIB-IIIB in FIG. 3A.

FIG. 3A is a cross-sectional view taken along the line IIIA-IIIA in FIG. 2B, and FIG. 3B is a cross-sectional view taken along the line IIIB-IIIB in FIG. 3A. In FIG. 3A, the seal sleeve 11 covers the tip of the conductor part 21 in which the covering section 22 of the covered electric wire 20 is removed, and the rear end of the seal sleeve 11 is compressed by the edge section of the crimp part 31 of the inner terminal 30, whereby water is prevented from entering from the tip of the conductor part 21 of the covered electric wire 20. Furthermore, in FIG. 3B, the conductor part 21, in which the covering section 22 of the covered electric wire 20 is removed, is crimped (or compressed) by the crimp part 31 of the inner terminal 30. Thus, the conductor part 21 cannot move relatively in a longitudinal direction by the serration 31S formed in the crimp part 31.

<Electric Wire with Outer Terminal and Inner Terminal>

Figure 4A:
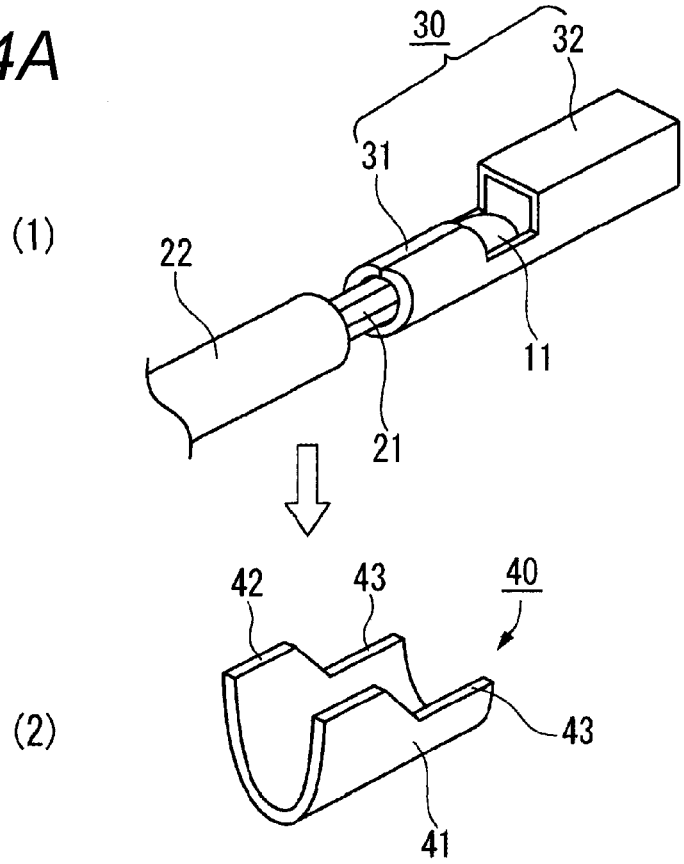
FIG. 4A is a perspective view before compression the covered electric wire with the inner terminal compressed thereto to an outer terminal, in which: (1) is a perspective view of the covered electric wire with the inner terminal compressed thereto; and (2) is a perspective view of the outer terminal.
Figure 4B:
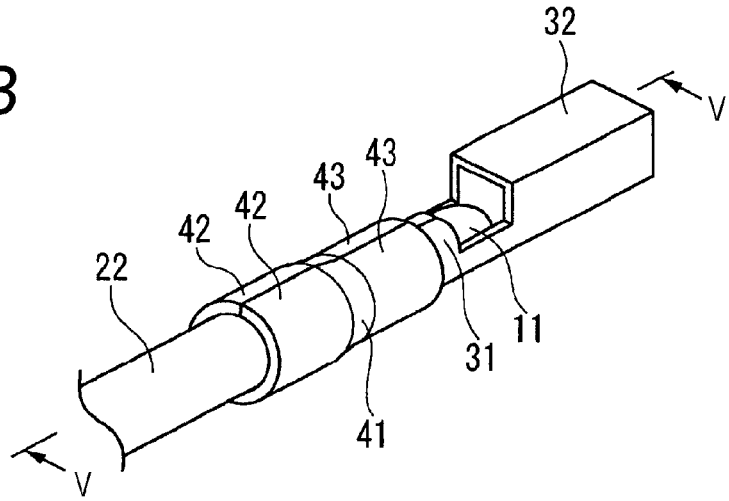
FIG. 4B is a perspective view after compression the covered electric wire with the inner terminal compressed thereto to the outer terminal

FIGS. 4A and 4B are diagrams that describe an aspect of compressing the covered electric wire, to which the inner terminal is compressed, to the outer terminal. Specifically, FIG. 4A is a perspective view before the compression, and FIG. 4B is a perspective view after the compression. Furthermore, in FIG. 4A, (1) is a perspective view of the covered electric wire to which the inner terminal is compressed, and (2) is a perspective view of the outer terminal. As shown in FIG. 4A(1), when the covered electric wire 20, in which the conductor part 21 is crimped by the crimp part 31 of the inner terminal 30, is compressed to the outer terminal 40 shown in FIG. 4A(2), an electric wire with the outer terminal and the inner terminal shown in FIG. 4B is obtained.

In FIG. 4A(2), the outer terminal 40 is formed by bending the conductive metal in a U shape. At a deployment barrel before being bent in the U shape, the length differs between a rear part 42 and a front part 43 in an axial direction, the deployment barrel length of the rear part 42 is longer than the deployment barrel length of the front part 43, and a difference in the deployment barrel length between the rear part 42 and the front part 43 is complemented by the slope of the edge section of the interconnecting section 41.

Thus, the covered electric wire 20 with the inner terminal 30 in FIG. 4A(1) is set to the outer terminal 40 shown in FIG. 4A(2). At that time, when accommodating, crimping and compression an axial central section of the crimp part 31 of the inner terminal 30 to the U-shaped groove of the front part 43 of the outer terminal 40, and the tip of the covering section 22 of the covered electric wire 20 to the U-shaped groove of the rear part 42 of the outer terminal 30, respectively, the electric wire with the outer terminal and the inner terminal as shown in FIG. 4B is obtained. As understood from the cross-sectional view of FIG. 5, in such an electric wire with the terminal, since the front part 43 of the outer terminal 40 is compressed to the inner terminal 30 and the rear part 42 of the outer terminal 40 is compressed to the covering section 22 of the covered electric wire 20, water does not enter the conductor part 21 of the covered electric wire 20.

Figure 5:
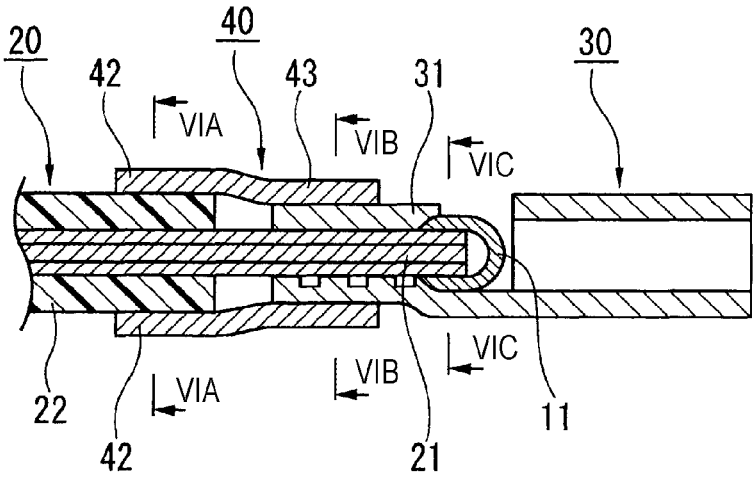
FIG. 5 is a cross-sectional view taken along a line V-V in FIG. 4B.

FIG. 5 is a cross-sectional view taken along the line V-V in FIG. 4B. In FIG. 5, the tip of the conductor part 21, in which the covering section 22 of the covered electric wire 20 is removed, is covered by the seal sleeve 11, and the rear end of the seal sleeve 11 is compressed by the edge section of the crimp part 31 of the inner terminal 30. Thus, water is prevented from entering from the tip of the conductor part 21.

Furthermore, the front part 43 of the outer terminal 40 is compressed to the crimp part 31 of the inner terminal 30 and the rear part 42 of the outer terminal 40 is compressed to the covering section 22 of the covered electric wire 20. Thus, water is prevented from entering the conductor part 21 from both ends of the outer terminal 40.

<Gap is Not Present in Any Cross-Section>

Figure 6A:
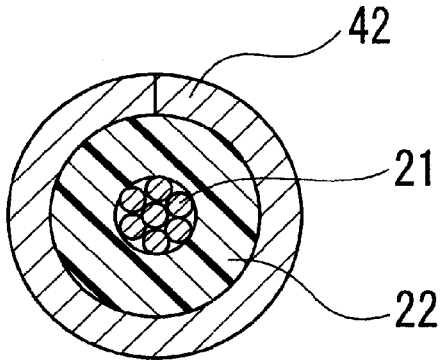
FIG. 6A is a cross-sectional view taken along a line VIA-VIA in FIG. 5.
Figure 6B:
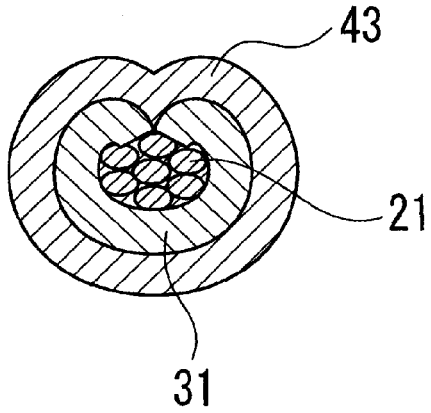
FIG. 6B is a cross-sectional view taken along a line VIB-VIB in FIG. 5.
Figure 6C:
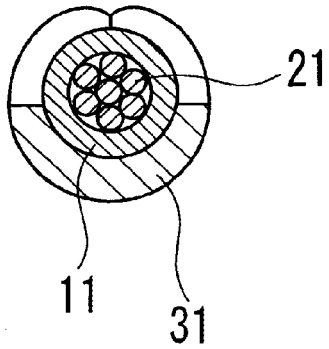
FIG. 6C is a cross-sectional view taken along a line VIC-VIC in FIG. 5.

FIG. 6A is a cross-sectional view taken along the line VIA-VIA in FIG. 5, FIG. 6B is a cross-sectional view taken along the line VIB-VIB in FIG. 5, and FIG. 6C is a cross-sectional view taken along the line VIC-VIC in FIG. 5.

(a) In FIG. 6A, the rear part 42 of the outer terminal 40 is compressed to the covering section 22 of the covered electric wire 20, and a gap is not present between the rear part 42 of the outer terminal 40 and the covering section 22 of the covered electric wire 20. Thus, water does not enter therefrom.

(b) In FIG. 6B, the front part 43 of the outer terminal 40 is compressed to the crimp part 31 of the inner terminal 30, and a gap is not present between the front part 43 of the outer terminal 40 and the crimp part 31 of the inner terminal 30. Thus, water does not enter therefrom.

(c) In FIG. 6C, since the tip of the crimp part 31 of the inner terminal 30 is compressed to the rear end of the seal sleeve 11, a gap is not present between the crimp part 31 and the seal sleeve 11. Thus, water does not enter therefrom.

In this manner, according to the embodiment of the present invention, water does not enter from any location of the covered electric wire 20 in the longitudinal direction. Accordingly, even in the electric wire with the terminal using the aluminum electric wire and the copper terminal, there is no galvanic corrosion due to the electric potential difference between the different metals, and thus there is no concern that the electric resistance of the compression section may rise and the mechanical fixing force may fall.

<Modified Example of Serration 31S>

Figure 7A:
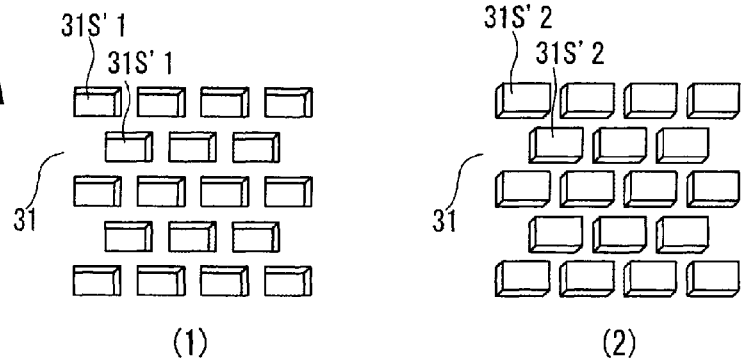
FIG. 7A is a plan view of rectangular concave serrations (1) and convex serrations (2), which are formed in the crimp part of the inner terminal.
Figure 7B:
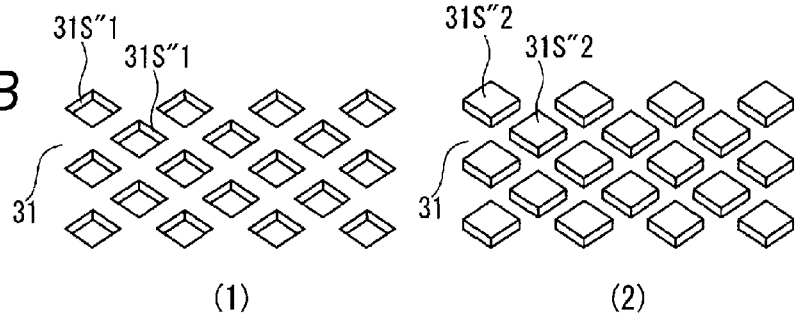
FIG. 7B is a plan view of diamond-shaped concave serrations (1) and convex serrations (2), which are formed in the crimp part of the inner terminal.
Figure 7C:
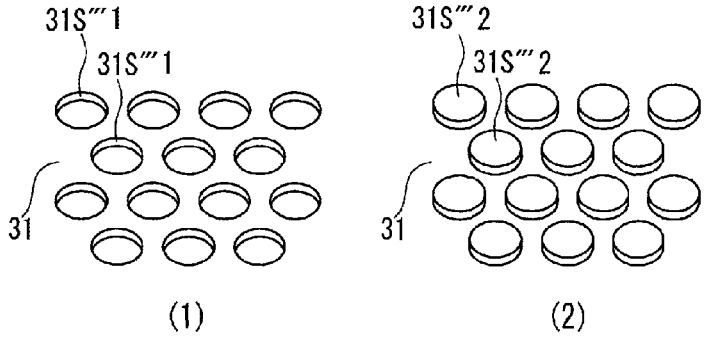
FIG. 7C is a plan view of circular concave serrations (1) and convex serrations (2), which are formed in the crimp part of the inner terminal.

FIGS. 7A to 7C are plan views that show other suitable serrations with which the serration 31S using the long grooves formed in the crimp part 31 of the inner terminal 30 (FIG. 2A(2)) is replaced. FIG. 7A is a rectangular serration 31S', FIG. 7B is a diamond-shape serration 31S", and FIG. 7C is a circular serration 31S'". Furthermore, each drawing includes (1) and (2), (1) is the serration using the concave section, and (2) is the serration using the convex section.

<Rectangular-Shaped Serration 31S'>

In FIG. 7A, a rectangular shape 31S' of the first row and the odd numbered rows (S'1 of the concave section and S'2 of the convex section) and a rectangular shape 31S' of the second row and the even numbered rows are placed in a zigzag manner so as to be shifted each other in a parallel direction, and form a check pattern as a whole. In this manner, since the concave and convex serrations of the check pattern are strongly compressed to the conductor part 21 of the tip of the covered electric wire 20, as in the case of the linear serration 31S, the conductor part 21 cannot be relatively moved.

<Diamond-Shaped Serration 31S">

In FIG. 7B, a diamond shape 31S" of the first row and the odd numbered rows (S"1 of the concave section and S"2 of the convex section) and a diamond shape 31S" of the second row and the even numbered rows are placed in a zigzag manner so as to be shifted relative to each other in a parallel direction, and form a check pattern as a whole. In this manner, since the concave and convex serrations of the check pattern are strongly compressed to the conductor part 21 of the tip of the covered electric wire 20, as in the case of the linear serration 31S, the conductor part 21 cannot be relatively moved.

<Circular-Shaped Serration 31S'">

In FIG. 7C, a circular shape 31S'" of the first row and the odd numbered rows (S'"1 of the concave section and S'"2 of the convex section) and a circular shape 31S'" of the second row and the even numbered rows are placed in a zigzag manner so as to be shifted each other in a parallel direction, and form a check pattern as a whole. In this manner, since the concave and convex serrations of the check pattern are strongly compressed to the conductor part 21 of the tip of the covered electric wire 20, as in the case of the linear serration 31S, the conductor part 21 cannot be relatively moved.

<Conclusion>

With the electric wire compression method according to the embodiment of the present invention, since the waterproof seal sleeve is attached to the conductor part tip from which the covering section is removed, and the seal sleeve is compressed and connected by the inner terminal, a gap allowing water to enter is not formed between the conductor part tip and the inner terminal. Thus, since water does not enter, even in the aluminum electric wire and the electric wire with the copper terminal, galvanic corrosion due to the electric potential difference between the different metals is not generated. Accordingly, there is no concern that the electric resistance of the compression section may rise and the mechanical fixing force may fall.

Furthermore, since the cap-shaped seal sleeve formed of metal or resin is used as the waterproof seal sleeve, the waterproof can be simplified, and thus productivity is improved.

Additionally, since the serration is strongly compressed to the conductor part of the tip of the covered electric wire, by forming the serration including the plurality of concavities and convexities in the crimp part of the inner terminal by linear-shaped concavities and convexities, rectangular-shaped or diamond-shaped concavities and convexities, or circular-shaped concavities and convexities, the relative movement can be prevented and waterproofing is easy.

The present invention is useful when an electric wire with terminal is placed at a location where water, which can generate galvanic corrosion, may exist since water hardly enters the area of the conductor part of the electric wire due to the seal sleeve provided at the tip of the covered electric wire.

What is claimed is:

1. An electric wire with terminal, comprising:

an inner terminal including a crimp part that is crimped to compress a conductor part of a covered electric wire;

an outer terminal that is compressed to the inner terminal by a front part thereof and is compressed to the covered electric wire by a rear part thereof; and a waterproof seal sleeve that is attached to a tip of the conductor part of the covered electric wire, wherein the seal sleeve is crimped by the crimp part of the inner terminal.

2. The electric wire with terminal according to claim 1, wherein the waterproof seal sleeve includes a seal sleeve having a cap shape formed of metal or resin.

3. The electric wire with terminal according to claim 1, wherein the crimp part of the inner terminal is provided with a serration formed of a plurality of concavities and convexities.

* * * * *